US011076230B2

(12) United States Patent
Maeno et al.

(10) Patent No.: US 11,076,230 B2
(45) Date of Patent: Jul. 27, 2021

(54) SPEAKER ARRAY, AND SIGNAL PROCESSING APPARATUS

(71) Applicant: SONY CORPORATION, Tokyo (JP)

(72) Inventors: Yu Maeno, Tokyo (JP); Yuhki Mitsufuji, Tokyo (JP)

(73) Assignee: SONY CORPORATION, Tokyo (JP)

( * ) Notice: Subject to any disclaimer, the term of this patent is extended or adjusted under 35 U.S.C. 154(b) by 20 days.

(21) Appl. No.: 16/611,582

(22) PCT Filed: May 2, 2018

(86) PCT No.: PCT/JP2018/017485
§ 371 (c)(1),
(2) Date: Nov. 7, 2019

(87) PCT Pub. No.: WO2018/211984
PCT Pub. Date: Nov. 22, 2018

(65) Prior Publication Data
US 2021/0084412 A1 Mar. 18, 2021

(30) Foreign Application Priority Data
May 16, 2017 (JP) ..... JP2017-097421

(51) Int. Cl.
*H04R 29/00* (2006.01)
*H04R 3/12* (2006.01)
*H04R 1/40* (2006.01)

(52) U.S. Cl.
CPC ..... *H04R 3/12* (2013.01); *H04R 1/403* (2013.01); *H04R 29/002* (2013.01); *H04R 2201/401* (2013.01)

(58) Field of Classification Search
CPC ..... H04R 29/00
See application file for complete search history.

(56) References Cited

U.S. PATENT DOCUMENTS 8,917,881 B2 * 12/2014 Jenq ..... H04R 1/26 381/77
9,596,544 B1 * 3/2017 Brotherton ..... H04R 19/02
(Continued)

FOREIGN PATENT DOCUMENTS

CN 1764330 A 4/2006
CN 206061115 U 3/2017
(Continued)

OTHER PUBLICATIONS

Samarasinghe, et al., "3D Soundfield Reproduction Using Higher Order Loudspeakers" IEEE International Conference on Acoustics, Speech and Signal Processing , Oct. 21, 2013, pp. 306-310.
International Search Report and Written Opinion of PCT Application No. PCT/JP2018/017485, dated Jul. 24, 2018, 06 pages of ISRWO.
(Continued)

*Primary Examiner* — Olisa Anwah
(74) *Attorney, Agent, or Firm* — Chip Law Group

(57) ABSTRACT

The present technology relates to a speaker array designed to be capable of achieving sufficiently high reproducibility at low cost, and a signal processing apparatus. The speaker array is formed with a plurality of higher order speakers and a plurality of general speakers. The type, the number, or the installation positions of the higher order speakers are determined in accordance with wavefront reproducibility in a second region located on the outer side of a first region that can be controlled by the general speakers. The present technology can be applied to a speaker array and a sound field forming apparatus.

14 Claims, 10 Drawing Sheets

(56) References Cited

U.S. PATENT DOCUMENTS

| | | | | |
|---|---|---|---|---|
| 2004/0240697 | A1* | 12/2004 | Keele, Jr. | H04R 3/12 381/336 |
| 2010/0142733 | A1* | 6/2010 | Choi | H04R 3/12 381/300 |
| 2010/0322445 | A1* | 12/2010 | Jakowski | H04R 27/00 381/182 |
| 2014/0098966 | A1* | 4/2014 | Corteel | H04R 3/12 381/59 |
| 2015/0110310 | A1* | 4/2015 | Minnaar | H04R 25/30 381/307 |
| 2016/0269848 | A1* | 9/2016 | Mitsufuji | H04S 7/30 |
| 2017/0006379 | A1* | 1/2017 | Falourd | H04R 1/323 |
| 2017/0195815 | A1* | 7/2017 | Christoph | H04S 7/303 |
| 2019/0014433 | A1* | 1/2019 | Magariyachi | H04S 3/008 |
| 2019/0108837 | A1* | 4/2019 | Christoph | G10L 15/22 |
| 2019/0230435 | A1* | 7/2019 | Maeno | H04S 7/303 |

FOREIGN PATENT DOCUMENTS

| | | |
|---|---|---|
| JP | 2016-144129 A | 8/2016 |
| JP | 2017-034442 A | 2/2017 |

OTHER PUBLICATIONS

Samarasinghe, et al., "3d Soundfield Reproduction Using Higher Order Loudspeakers", International Conference on Acoustics, Speech and Signal Processing (ICASSP), IEEE, Oct. 21, 2013, pp. 306-310.

Carpentier, et al., "Holophonic Sound in IRCAM's Concert Hall:Technological and Aesthetic Practices", Computer Music Journal, vol. 40, No. 04, Apr. 21, 2017, 21 pages.

Samarasinghe, et al.,"3D Soundfield Reproduction Using Higher Order Loudspeakers", IEEE International Conference on Acoustics,Speech and Signal Processing—Proceedings IEEE, May 26, 2013, 05 pages.

Office Action for CN Patent Application No. 201880030916.8, dated Nov. 27, 2020, 09 pages of Office Action and 10 pages of English Translation.

Klein, et al.,"Optimized Spherical Sound Source for Auralization with Arbitrary Source Directivity", Proceedings of the EAA Joint Symposium on Auralization and Ambisonics, Berlin, Germany, XP055795645, Apr. 3-5, 2014, 56-61 pages.

Office Action for EP Patent Application No. 18802522.5, dated Apr. 22, 2021, 08 pages of Office Action.

* cited by examiner

SPEAKER ARRAY, AND SIGNAL PROCESSING APPARATUS

CROSS REFERENCE TO RELATED APPLICATIONS

This application is a U.S. National Phase of International Patent Application No. PCT/JP2018/017485 filed on May 2, 2018, which claims priority benefit of Japanese Patent Application No. JP 2017-097421 filed in the Japan Patent Office on May 16, 2017. Each of the above-referenced applications is hereby incorporated herein by reference in its entirety.

TECHNICAL FIELD

The present technology relates to a speaker array and a signal processing apparatus, and more particularly, to a speaker array designed to be capable of achieving sufficiently high reproducibility at low cost, and a signal processing apparatus.

BACKGROUND ART

In sound field reproduction by Higher Order Ambisonics (HOA), for example, a larger number of speakers are required to reproduce a sound field in a wider region. This is because control needs to be performed on even higher order components of signals in a spherical harmonics region or an annular harmonics region of HOA.

Further, a method using a speaker array called a higher order speaker is also known as another method of controlling higher order components.

A higher order speaker is also called a higher order loudspeaker (HOL), and is a speaker capable of reproducing a plurality of directionalities such as monopoles and dipoles. In practice, an annular speaker array, a spherical speaker array, or the like obtained by annularly or spherically arranging a large number of speaker units is used as a higher order speaker.

As a large number of such higher order speakers are annularly or spherically arranged, it becomes possible to reproduce a sound field in a wider region, or, in other words, to reproduce the wavefront of sound.

Specifically, there is a technique suggested for reproducing a sound field on the inner side and the outer side of a speaker array that is formed by arranging a large number of higher order speakers, for example (see Non-Patent Document 1, for example).

CITATION LIST

Non-Patent Document

Non-patent document 1: Samarasinghe, Prasanga N., et al. "3D sound field reproduction using higher order loudspeakers." 2013 IEEE International Conference on Acoustics, Speech and Signal Processing. IEEE, 2013

SUMMARY OF THE INVENTION

Problems to be Solved by the Invention

However, with the above described technique, it is difficult to achieve sufficiently high reproducibility at low cost.

For example, it is possible to reproduce a sound field in a wide region with a speaker array formed by arranging a large number of higher order speakers. However, a higher order speaker is more expensive than a general speaker that can reproduce only one directionality, and using a large number of higher order speakers is not practical.

Further, in a case where sound field reproduction is performed with a speaker array obtained by arranging a plurality of higher order speakers, if the number of higher order speakers constituting the speaker array is reduced, sound field reproducibility, or in other words, wavefront reproducibility, becomes lower.

The present technology has been made in view of such circumstances, and is to enable achievement of sufficiently high reproducibility at low cost.

Solutions to Problems

A speaker array according to a first aspect of the present technology includes a plurality of higher order speakers and a plurality of general speakers, and the type, the number, or the installation positions of the higher order speakers are determined in accordance with wavefront reproducibility in a second region located on the outer side of a first region that can be controlled by the general speakers.

In the first aspect of the present technology, a speaker array includes a plurality of higher order speakers and a plurality of general speakers, and the type, the number, or the installation positions of the higher order speakers are determined in accordance with wavefront reproducibility in a second region located on the outer side of a first region that can be controlled by the general speakers.

A signal processing apparatus according to a second aspect of the present technology includes: a speaker array including a plurality of higher order speakers and a plurality of general speakers, with the type, the number, or the installation positions of the higher order speakers being determined in accordance with wavefront reproducibility in a second region located on the outer side of a first region that can be controlled by the general speakers; and a drive signal generation unit that generates a drive signal for the speaker array on the basis of a source signal.

In the second aspect of the present technology, a speaker array including a plurality of higher order speakers and a plurality of general speakers is provided in a signal processing apparatus, with the type, the number, or the installation positions of the higher order speakers being determined in accordance with wavefront reproducibility in a second region located on the outer side of a first region that can be controlled by the general speakers. On the basis of a source signal, a drive signal for the speaker array is generated in the signal processing apparatus.

Effects of the Invention

According to the first and second aspects of the present technology, sufficiently high reproducibility can be achieved at low cost.

Note that the effects of the present technology are not limited to the effects described herein, and may include any of the effects described in the present disclosure.

MODES FOR CARRYING OUT THE INVENTION

The following is a description of embodiments to which the present technology is applied, with reference to the drawings.

<First Embodiment>

<Outline of the Present Technology>

The present technology is to enable achievement of sufficiently high sound field reproducibility even at low cost by forming a speaker array with a combination of higher order speakers and general speakers.

Note that a higher order speaker is a speaker capable of reproducing a plurality of directionalities. Specifically, a higher order speaker is an annular speaker array or a spherical speaker array obtained by arranging a plurality of speaker units in an annular or spherical form, for example.

A higher order speaker is normally formed with a plurality of speaker units. For example, since the plurality of speaker units constituting a higher order speaker is oriented in different directions from one another, the radiation directions (output directions) of the sounds from the plurality of speaker units are different from one another.

Further, in a case where desired directionalities are reproduced by a higher order speaker, some of the speaker drive signals supplied to the plurality of speaker units constituting the higher order speaker may be the same or may be different from one another.

Meanwhile, a general speaker is a speaker capable of reproducing only a single directionality, and is normally formed with one speaker unit. Specifically, a general speaker is a loudspeaker or the like, for example.

Further, in the description below, the term "high reproducibility of a sound field" means that there is little difference between an ideal sound field to be reproduced and a sound field actually formed.

In the present technology, a speaker array obtained by arranging one or more higher order speakers and one or more general speakers is used so that a desired sound field can be efficiently reproduced at low cost in the regions on the inner and outer side of the speaker array.

Note that a speaker array to which the present technology is applied, which is a speaker array formed with higher order speakers and general speakers, will be hereinafter also referred to as a global array. For example, a global array is a spherical speaker array in which a plurality of higher order speakers and general speakers are arranged in a spherical form, an annular speaker array in which a plurality of higher order speakers and general speakers are arranged in the form of a ring, or the like.

Figure 1:
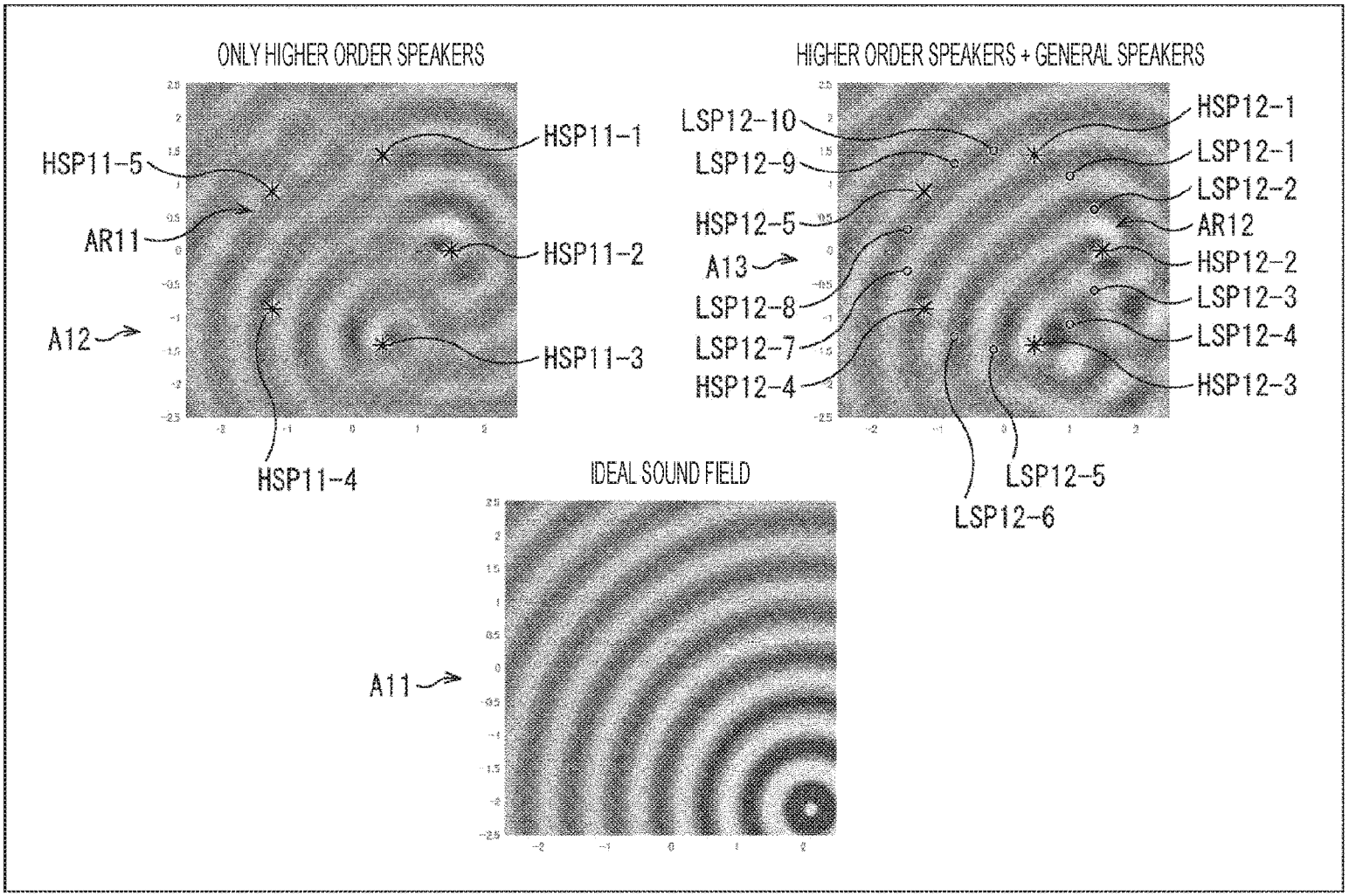
FIG. 1 is a diagram for explaining the present technology.

Here, the results of a simulation of sound field reproduction with a global array to which the present technology is applied are shown in FIG. 1. Note that, in FIG. 1, the vertical direction and the horizontal direction indicate positions in space, and the shades of gray at the respective positions indicate the sound pressures.

For example, the sound field indicated by an arrow A11 is assumed to be an ideal sound field (hereinafter also referred to as the ideal sound field), and the ideal sound field is reproduced with speaker arrays. In other words, the portion indicated by the arrow A11 shows the wavefront of the sound at the time of formation of the ideal sound field.

In this case, when the ideal sound field is reproduced with a speaker array AR11 formed only with higher order speakers, for example, the sound field indicated by an arrow A12 is actually formed.

In the example indicated by the arrow A12, the speaker array AR11 is formed with five higher order speakers HSP11-1 through HSP11-5 arranged in the form of a ring.

In this example, the number of speakers constituting the speaker array AR11 is not large enough, and therefore, the reproducibility of the sound field (wavefront) is low. In other words, the sound field formed by the speaker array AR11 has a great difference from the ideal sound field indicated by the arrow A11.

On the other hand, when the ideal sound field is reproduced with a global array AR12 that is a speaker array to which the present technology is applied, the sound field indicated by an arrow A13 is actually formed, for example.

In the example indicated by the arrow A13, the global array AR12 is an annular speaker array formed with five higher order speakers HSP12-1 through HSP12-5 and ten general speakers LSP12-1 through LSP12-10.

Note that the higher order speakers HSP12-1 through HSP12-5 will be hereinafter also referred to simply as the higher order speakers HSP12 unless it is necessary to specifically distinguish them from one another. Likewise, the general speakers LSP12-1 through LSP12-10 will be hereinafter also referred to simply as the general speakers LSP12 unless it is necessary to specifically distinguish them from one another.

In the global array AR12, the respective higher order speakers HSP12 and the respective general speakers LSP12 are arranged in the form of a ring so that two general speakers LSP12 are interposed between each two higher order speakers HSP12.

The sound field formed by the global array AR12 has a smaller difference from the ideal sound field than the sound field formed by the speaker array AR11, and has achieved sufficiently high sound field reproducibility in each region on the inner and outer side of the global array AR12.

As described above, the global array AR12 is formed with a total of 15 speakers: five higher order speakers HSP12 and ten general speakers LSP12.

As described above, a total of 15 speakers are used in the global array AR12. However, among these 15 speakers, the number of higher order speakers HSP12 that are expensive is only five, which is the same as that in a case with the speaker array AR11.

Further, since the remaining general speakers LSP12 forming the global array AR12 are inexpensive, it is safe to say that the cost of the global array AR12, which is the cost of installation of the global array AR12, is substantially the same as the cost of the speaker array AR11.

However, a comparison between the global array AR12 and the speaker array AR11 shows that the global array AR12 can achieve higher sound field reproducibility than in a case where the speaker array AR11 is used. In view of this, the global array AR12 to which the present technology is applied is capable of achieving sufficiently high sound field reproducibility at low cost.

Particularly, in a case where the global array AR12 is used, the rate of contribution of the general speakers LSP12 to sound field reproduction is high in the region on the inner side of the global array AR12, which is the region surrounded by the global array AR12. The general speakers LSP12 can be regarded as monopole sound sources, and the directionality of the general speakers LSP12 corresponds to lower order (zero-order) directionality.

On the other hand, the higher order speakers HSP12 are required for sound field reproduction in the region on the outer side of the global array AR12, which is the region outside the region surrounded by the global array AR12.

In the global array AR12, the higher order speakers HSP12 and the general speakers LSP12 are used in combination, so that sufficiently high sound field reproducibility can be achieved in the regions on the inner side and the outer side of the global array AR12.

Note that the installation positions of the higher order speakers HSP12 and the general speakers LSP12, the types of speakers, and the number of speakers are only required to be determined in accordance with (in association with) the sound field (wavefront) reproducibility in each region. For example, the type of a speaker indicates how many directionalities the higher order speaker can reproduce or the like.

The region that can be controlled by the general speakers LSP12, which is the region in which the general speakers LSP12 can contribute to formation of a sound field (wavefront), is referred to as the zero-order control region. Note that the higher order speakers HSP12 can also control the zero-order control region.

Meanwhile, the region that is located outside the zero-order control region and can be controlled by the higher order speakers HSP12, which is the region that is located outside the zero-order control region and in which the higher order speakers HSP12 can contribute to formation of a sound field (wavefront), is referred to as the higher order control region. Note that the general speakers LSP12 are not to control the higher order control region.

In this case, the region formed with the zero-order control region and the higher order control region is the region in which a sound field is to be formed by the global array AR12, or the region to be controlled. In other words, the region formed with the zero-order control region and the higher order control region is the control region in which sound field reproduction is to be performed by the global array AR12.

Note that the example to be described herein is an example in which the region on the inner side of the global array AR12 is the zero-order control region, and the region on the outer side of the global array AR12 is the higher order control region. However, depending on the radius of the global array AR12, the number of the higher order speakers HSP12, and the like, the zero-order control region and the higher order control region might be the regions on the inner side of the global array AR12.

In a case where sound field formation is performed by the global array AR12, if the number of the higher order speakers HSP12 forming the global array AR12, the installation positions of the higher order speakers HSP12, the type of the higher order speakers HSP12, and the like are determined in accordance with the sound field (wavefront) reproducibility in the higher order control region, for example, a sound field can be formed with sufficiently high reproducibility in the higher order control region.

Likewise, if the numbers of the higher order speakers HSP12 and the general speakers LSP12 constituting the global array AR12, the installation positions of the higher order speakers HSP12 and the general speakers LSP12, and the like are determined in accordance with the sound field (wavefront) reproducibility in the zero-order control region, a sound field can be formed with sufficiently high reproducibility in the zero-order control region.

<Example Configuration of a Sound Field Forming Apparatus>

The following is a description of a more specific embodiment to which the present technology is applied.

Figure 2:
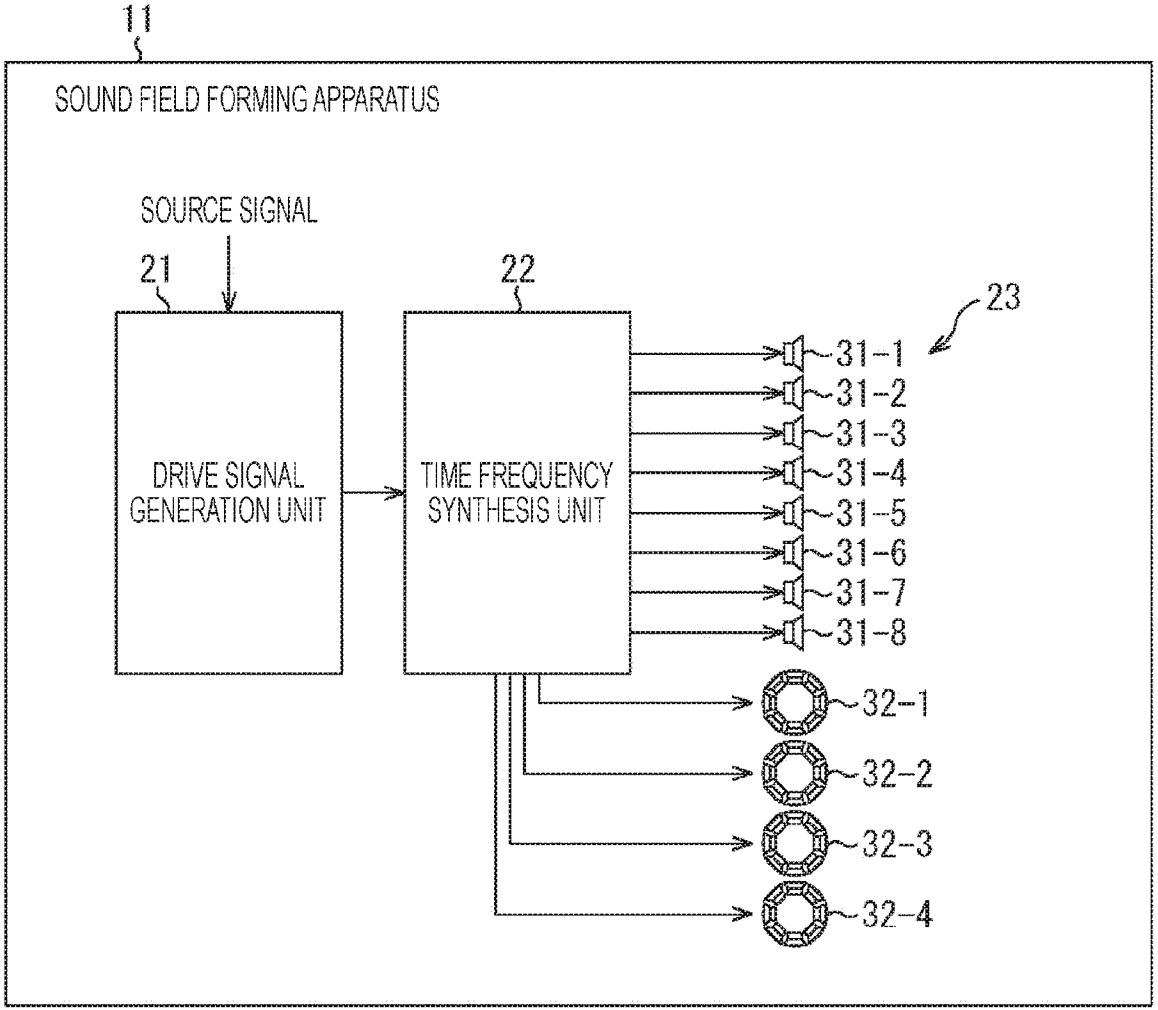
FIG. 2 is a diagram showing an example configuration of a sound field forming apparatus.

FIG. 2 is a diagram showing an example configuration of an embodiment of a sound field forming apparatus to which the present technology is applied.

A sound field forming apparatus 11 shown in FIG. 2 includes a drive signal generation unit 21, a time frequency synthesis unit 22, and a global array 23.

The drive signal generation unit 21 is supplied with a source signal that is an acoustic signal (a temporal signal) in a time domain for reproducing the sound of content. On the basis of the supplied source signal, the drive signal generation unit 21 generates a time frequency spectrum of a speaker drive signal for reproducing the sound based on the source signal on a desired wavefront, and supplies the time frequency spectrum to the time frequency synthesis unit 22.

The time frequency synthesis unit 22 performs time frequency synthesis using inverse discrete Fourier transform (IDFT) on the time frequency spectrum supplied from the drive signal generation unit 21, to calculate and supply a speaker drive signal as a temporal signal to the global array 23.

The global array 23 outputs a sound on the basis of the speaker drive signal supplied from the time frequency synthesis unit 22, to form a desired sound field (wavefront).

For example, the global array 23 is equivalent to the global array AR12 shown in FIG. 1, and is formed with general speakers 31-1 through 31-8 and higher order speakers 32-1 through 32-4.

Note that, hereinafter, the general speakers 31-1 through 31-8 will be also referred to simply as the general speakers 31 unless it is necessary to specifically distinguish the general speakers 31-1 through 31-8 from one another. Likewise, hereinafter, the higher order speakers 32-1 through 32-4 will be also referred to simply as the higher order speakers 32 unless it is necessary to specifically distinguish the higher order speakers 32-1 through 32-4 from one another.

The general speakers 31 are equivalent to the general speakers LSP12 shown in FIG. 1, and the higher order speakers 32 are equivalent to the higher order speakers HSP12 shown in FIG. 1.

The global array 23 is a spherical speaker array, an annular speaker array, or the like obtained by arranging the general speakers 31 and the higher order speakers 32 in a spherical or annular form, for example. Note that the global array 23 is not necessarily a spherical speaker array or an annular speaker array, and may be a speaker array of any other type.

Further, the numbers and the installation positions of the general speakers 31 and the higher order speakers 32 constituting the global array 23, and the type of the higher order speakers are determined in accordance with the wavefront reproducibility in the zero-order control region and the higher order control region.

(Drive Signal Generation Unit)

The respective components that constitutes the sound field forming apparatus 11 is now described in greater detail.

The drive signal generation unit 21 generates a time frequency spectrum of a speaker drive signal supplied to the respective speaker units constituting the higher order speakers 32 and the general speakers 31, on the basis of a supplied source signal.

In the description below, a specific example of generation of a time frequency spectrum is described.

Figure 3:
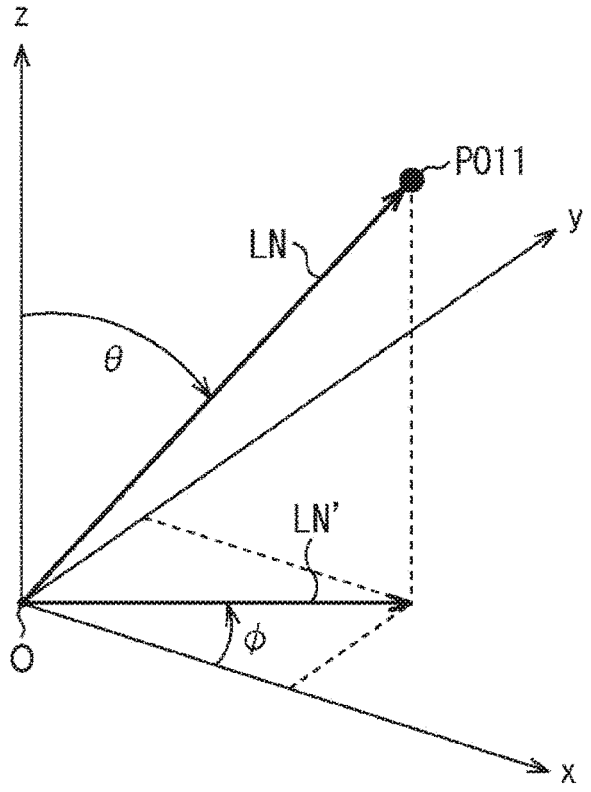
FIG. 3 is a diagram for explaining a coordinate system.

For example, as shown in FIG. 3, the position of a point PO11 in a three-dimensional orthogonal coordinate system that has a predetermined origin O as the reference and has the x-, y-, and z-axes as the respective axes is represented by polar coordinates (spherical coordinates).

In other words, the position of the predetermined point PO11 is expressed as (r, θ, φ) in polar coordinates, with the reference being the origin O. Here, r represents the distance to the point PO11 viewed from the origin O, θ represents the elevation angle indicating the position of the point PO11 viewed from the origin O, and φ represents the azimuth angle indicating the position of the point PO11 viewed from the origin O.

In this case, with a straight line LN being the straight line connecting the origin O and the point PO11, the length of the straight line LN is the distance r to the point PO11 viewed from the origin O.

Further, with a straight line LN' being the straight line obtained by projecting the straight line LN onto the x-y plane from the z-axis direction, the angle between the x-axis and the straight line LN' is the azimuth angle φ indicating the position of the point PO11 viewed from the origin O, for example. Further, the angle between the z-axis and the straight line LN is the elevation angle θ indicating the position of the point PO11 viewed from the origin O.

Hereinafter, a predetermined position is expressed as (r, θ, φ), using polar coordinates.

Meanwhile, a predetermined position X inside a speaker array having its origin at the center position of the region surrounded by the speaker array formed with a plurality of general speakers, or in the region surrounded by the speaker array, is expressed as X=(r, θ, φ). In this case, the sound field Pi (X, ω) at the position X=(r, θ, φ) can be expressed by Equation (1) shown below, using a spherical harmonics function $Y_{nm}$ (θ, φ, a Bessel function $j_n$ (kr), and a coefficient $A_{nm}$ (ω).

[Mathematical Formula 1]

$$Pi(X, \omega) = \sum_{n=0}^{N} \sum_{m=-n}^{n} A_{nm}(\omega) j_n(kr) Y_{nm}(\theta, \phi) \tag{1}$$

Note that, in Equation (1), n and m represent orders, and N represents the maximum order. Further, ω represents the angular frequency, and k represents the wave number.

Likewise, the sound field Pe (X, ω) at the position X=(r, θ, φ) outside the speaker array can be expressed by Equation (2) shown below, using a spherical harmonics function $Y_{nm}$ (θ, φ), a Hankel function $h_n$ (kr), and a coefficient $B_{nm}$ (ω).

[Mathematical Formula 2]

$$Pe(X, \omega) = \sum_{n=0}^{N} \sum_{m=-n}^{n} B_{nm}(\omega) h_n(kr) Y_{nm}(\theta, \phi) \tag{2}$$

Note that, in the description below, the mark of the angular frequency ω is omitted to make the notation easier to understand.

Here, a case with a global array obtained by arranging higher order speakers in a spherical form is described. With the origin being the center position of the global array, a synthetic sound field $P_{syn}$ (X) formed by the global array at the predetermined position X viewed from the origin can be expressed by Equation (3) shown below, using Equation (2).

[Mathematical Formula 3]

$$P_{syn}(X) = \sum_{l=1}^{L} \sum_{n'=0}^{N'} \sum_{m'=-n'}^{n'} d_l \beta^{(l)}_{n'm'} h_{n'}(kr^{(l)}) Y_{n'm'}(\theta^{(l)}, \phi^{(l)}) \tag{3}$$

In Equation (3), 1 represents the speaker index for identifying the speaker units constituting the global array, and l is 1, 2, . . . , and L. Further, L represents the total number of the speaker units constituting the global array. Note that the speaker units identified by the speaker index l are the speaker units constituting the higher order speakers of the global array.

Further, in Equation (3), $d_l$ represents the speaker drive signal of the speaker unit of the speaker index 1, or more specifically, represents the time frequency spectrum of the speaker drive signal, and $\beta^{(l)}_{n'm'}$ represents the coefficient indicating the directional characteristics of the speaker unit of the speaker index l.

Furthermore, in Equation (3), $h_{n'}$ ($kr^{(l)}$) and $Y_{n'm'}$ ($\theta^{(l)}$, $\varphi^{(l)}$) represent the Hankel function and the spherical harmonics function expressed by the polar coordinates, with the reference (origin) being the position of the speaker unit of speaker index l.

In other words, the Hankel function $h_{n'}$'($kr^{(l)}$) and the spherical harmonics function $Y_{n'm'}$ ($\theta^{(l)}$, $\varphi^{(l)}$) are the Hankel function and the spherical harmonics function for the position X=($r^{(l)}$, $\theta^{(l)}$, $\varphi^{(l)}$) in the polar coordinate system having its origin at the position of the speaker unit of the speaker index 1. Further, n' and m' represent the orders when the origin is the position of the speaker unit of the speaker index 1.

Note that the coefficient $\beta^{(l)}_{n'm'}$ is also a coefficient in the polar coordinate system having its origin at the position of the speaker unit of the speaker index l.

Therefore, to control a sound field in the region surrounded by the global array, for example, the coefficient $\beta^{(l)}_{n'm'}$ needs to be converted into a coefficient $\beta^{(O)}_{nm,l}$, with the origins of the polar coordinate system being the center position of the global array.

It is possible to perform such conversion from the coefficient $\beta^{(l)}_{n'm'}$ to the coefficient $\beta^{(O)}_{nm,l}$ using the Hankel function addition theorem. In other words, it is possible to convert the coefficient $\beta^{(l)}_{n'm'}$ into the coefficient $\beta^{(O)}_{nm,l}$ by performing calculation according to Equation (4) shown below.

Note that the Hankel function addition theorem is specifically described by P. A. Martin in "Multiple scattering:

interaction of time-harmonic waves with N obstacles", Cambridge Univ Pr, 2006", and the like, for example.

[Mathematical Formula 4]

$$\beta_{nm,l}^{(0)} = \sum_{n'=0}^{N'} \sum_{m'=-n'}^{n'} \beta_{n'm'}^{(l)} S_{n'n}^{m'm}(X_l) \tag{4}$$

In Equation (4), $X_1$ represents the position of the speaker unit of the speaker index l viewed from the origin that is the center position of the global array, and the position $X_l$ is expressed as $X_l=(r_l, \theta_l, \varphi_l)$.

Further, $S^{m'm}_{n'n}(X_l)$ in Equation (4) is expressed by Equation (5) shown below.

[Mathematical Formula 5]

$$S_{n'n}^{m'm}(X_l) = i^{(n-n'+4m'-2m)} \sum_{q=0}^{n+n'} i^l h_l(kr_l) Y^*_{q(m-m')}(\theta_l, \phi_l) \sqrt{4\pi(2n+1)(2n'+1)(2q+1)}\, W_1 W_2 \tag{5}$$

Note that, in Equation (5), i represents the imaginary number, $h_l(kr_l)$ represents the Hankel function for the speaker unit of the speaker index l, and $Y^*_{q(m-m')}(\theta_l, \varphi_l)$ represents the complex conjugate of the spherical harmonics function $Y_{q(m-m')}(\theta_l, \varphi_l)$.

Further, $W_1$ in Equation (5) is a matrix expressed by Equation (6) shown below, and $W_2$ is a matrix expressed by Equation (7) shown below. These matrices $W_1$ and $W_2$ are called Wigner 3-j symbols.

[Mathematical Formula 6]

$$W_1 = \begin{pmatrix} n' & n & q \\ 0 & 0 & 0 \end{pmatrix} \tag{6}$$

[Mathematical Formula 7]

$$W_2 = \begin{pmatrix} n' & n & q \\ m' & -m & (m-m') \end{pmatrix} \tag{7}$$

Using Equation (4), it is possible to convert the coefficient $\beta^{(l)}_{n'm'}$ based on each speaker unit into the coefficient $\beta^{(O)}_{nm,l}$ based on the global array.

Here, the transfer function of each speaker unit is discussed. Equation (4) can also be applied to conversion from a transfer function coefficient with the center position of each speaker as the origin to a transfer function coefficient with the center position of the global array as the origin.

In other words, on the basis of Equation (1) and Equation (4) described above, the transfer function $g_l(X)$ of the speaker unit of the speaker index l with respect to the predetermined position X based on the global array is expressed by Equation (8) shown below using the coefficient $\beta^{(O)}_{nm,l}$, the Bessel function $j_n(kr)$, and the spherical harmonics function $Y_{nm}(\theta, \varphi)$.

[Mathematical Formula 8]

$$g_l(X) = \sum_{n=0}^{N} \sum_{m=-n}^{n} \beta_{nm,l}^{(0)} j_n(kr) Y_{nm}(\theta, \phi) \tag{8}$$

Note that a spherical speaker array obtained by arranging higher order speakers in a spherical form has been described as an example of the global array formed with L speaker units.

However, the global array formed with L speaker units may be a spherical speaker array obtained by arranging higher order speakers and general speakers in a spherical form. In other words, the speaker unit of the speaker index l may be a single speaker unit of a higher order speaker, or may be a general speaker.

For example, the coefficient $\beta^{(l)}_{n'm'}$ is a parameter that determines the directional characteristics of a speaker unit. However, in a case where the speaker unit is a general speaker, the coefficient $\beta^{(l)}_{n'm'}$ has a value only for the zero-order component. In other words, for the coefficient $\beta^{(l)}_{n'm'}$ of a general speaker as the speaker unit of the speaker index l, the value of the coefficient $\beta^{(l)}_{n'm'}$ other than the coefficient $\beta^{(l)}_{00}$, which is a zero-order component, is 0.

In the description continuing below, the global array formed with L speaker units is a spherical speaker array formed with higher order speakers and general speakers.

Further, like the transfer function $g_l(X)$, a sound field $\alpha(X)$ at the predetermined position X based on the global array can be expressed by Equation (9) shown below using a coefficient $a^{(O)}_{nm}$, the Bessel function $j_n(kr)$, and the spherical harmonics function $Y_{nm}(\theta, \varphi)$.

[Mathematical Formula 9]

$$\alpha(X) = \sum_{n=0}^{N} \sum_{m=-n}^{n} a_{nm}^{(0)} j_n(kr) Y_{nm}(\theta, \phi) \tag{9}$$

For example, a spherical wave analytical solution is used, so that the coefficient $a^{(O)}_{nm}$ in Equation (9) can be obtained by calculation according to Equation (10), with the polar coordinates of the sound source position being $(r_s, \theta_s, \varphi_s)$.

[Mathematical Formula 10]

$$a_{nm}^{(0)} = -ikh_n^{(2)}(kr_s) Y_{nm}^*(\theta_s, \phi_s) \tag{10}$$

Note that in Equation (10), i represents the imaginary number, k represents a wave number, and $h^{(2)}_n(kr_s)$ represents a spherical Hankel function of the second kind. Further, $Y^*_{nm}(\theta_s, \varphi_s)$ represents the complex conjugate of the spherical harmonics function $Y_{nm}(\theta_s, \varphi_s)$.

Particularly, in a case where the source signal of the sound to be reproduced by the global array is supplied, the coefficient $a^{(O)}_{nm}$ is expressed by Equation (11) shown below using a source signal S.

[Mathematical Formula 11]

$$a_{nm}^{(0)} = -ikh_n^{(2)}(kr_s) Y_{nm}^*(\theta_s, \phi_s) \times S \tag{11}$$

Here, the transfer function $g_l(X)$ shown in Equation (8) and the sound field $\alpha(X)$ shown in Equation (9) can be expressed by matrices, as in Equation (12) and Equation (13) shown below.

[Mathematical Formula 12]

$$g(X) = \psi C^H \tag{12}$$

[Mathematical Formula 13]

$$\alpha(X)=\psi a^H \tag{13}$$

Note that, in Equation (12), g (X) represents a matrix (row vector) formed with the transfer functions $g_l$ (X) of the L speaker units of the respective speaker indexes l.

Further, ψ in Equation (12) and Equation (13) represents a matrix (row vector) expressed by Equation (14) shown below. In Equation (12), $C^H$ represents a Hermitian transpose of a matrix C formed with the coefficients $\beta^{(O)}{}_{nm,l}$, as shown in Equation (15) below.

Further, in Equation (13), $a^H$ represents a Hermitian transpose of a matrix (row vector) a formed with the coefficients $a^{(O)}{}_{nm}$, as shown in Equation (16) below.

[Mathematical Formula 14]

$$\psi = [j_0(kr)Y_{00}(\theta, \phi), \ldots, j_N(kr)Y_{NN}(\theta, \phi)] \tag{14}$$

[Mathematical Formula 15]

$$C = \begin{bmatrix} \beta^{(0)}_{00,1} & \cdots & \beta^{(0)}_{NN,1} \\ \vdots & \ddots & \vdots \\ \beta^{(0)}_{00,L} & \cdots & \beta^{(0)}_{NN,L} \end{bmatrix} \tag{15}$$

[Mathematical Formula 16]

$$a = [a^{(0)}_{00}, \cdots, a^{(0)}_{NN}] \tag{16}$$

Here, the region in which a sound field (wavefront) is to be reproduced is set as a control region V. In this case, the solution of the minimization problem of the equation shown in Equation (17) below is calculated, to obtain a matrix D formed with the time frequency spectrums of drive signals for the respective speaker units constituting the global array.

[Mathematical Formula 17]

$$\underset{D}{\text{minimize}}\ F = \int\int_V |g(X)D - \alpha(X)|dX \tag{17}$$

Note that the matrix D in Equation (17) is a matrix formed with the time frequency spectrums $d_l$ of the speaker drive signals for the speaker units of the respective speaker indexes 1 as shown in Equation (18) below.

[Mathematical Formula 18]

$$D=[d_1,d_2, \ldots ,d_L]^H \tag{18}$$

Further, where the radius of the control region V is represented by $R_O$, Equation (17) is expanded with Equation (12) and Equation (13), so that the matrix D formed with the time frequency spectrums $d_l$ can be determined at last according to Equation (19) shown below.

[Mathematical Formula 19]

$$D=(C^HWC)^{-1}C^HWa \tag{19}$$

Note that, in Equation (19), W represents a matrix expressed by Equation (20) shown below, and $w_{nm}$, which is an element of the matrix W, is expressed by Equation (21) shown below.

[Mathematical Formula 20]

$$W = \begin{bmatrix} w_{00} & \cdots & w_{0N} \\ \vdots & \ddots & \vdots \\ w_{N0} & \cdots & w_{NN} \end{bmatrix} \tag{20}$$

[Mathematical Formula 21]

$$w_{nm} = \pi R_0^3 \delta_{nm}\{j_n^2(kR_0) - j_{n-1}(kR_0)j_{n+1}(kR_0)\} \tag{21}$$

In Equation (21), $\delta_{nm}$ represents Kronecker delta, and the matrix W expressed by Equation (20) is a diagonal matrix.

The drive signal generation unit 21 performs calculation according to Equation (19) using the coefficient $a^{(O)}{}_{nm}$ that is obtained on the basis of the supplied source signal S and is expressed by the above Equation (11), to determine the time frequency spectrums $d_l$ of the respective speaker units constituting the global array 23, and supply the time frequency spectrums $d_l$ to the time frequency synthesis unit 22. Here, the speaker units of the speaker indexes 1 are equivalent to the general speakers 31 and the speaker units of the higher order speakers 32, which constitute the global array 23.

Note that the method of obtaining the time frequency spectrums $d_l$ by expanding Equation (17) is specifically described by Ueno, et al. in "Sound Field Reproduction Using Prior Information about Reception Area: Verification with Linear Array, Reports of the autumn meeting of Acoustical Society of Japan in 2016, pp. 415-418", and the like, for example.

(Time Frequency Synthesis Unit)

The time frequency synthesis unit 22 performs time frequency synthesis using IDFT on the time frequency spectrums $d_l$ of speaker drive signals supplied from the drive signal generation unit 21, to determine the speaker drive signals for the speaker units of the respective speaker indexes l, which are temporal signals.

For example, a time frequency index is represented by $n_{tf}$, and the time frequency spectrum $d_l$ of the speaker unit of a speaker index l is expressed as a time frequency spectrum D (l, $n_{tf}$).

In this case, the time frequency synthesis unit 22 obtains the speaker drive signal d (l, $n_t$) for the speaker unit of the speaker index l by performing calculation according to Equation (22) shown below.

[Mathematical Formula 22]

$$d(l, n_t) = \frac{1}{M_{dt}} \sum_{n_{tf}=0}^{M_{dt}-1} D(l, n_{tf}) e^{i\frac{2\pi n_t n_{tf}}{M_{dt}}} \tag{22}$$

Note that, in Equation (22), $n_t$ represents the time index, $M_{dt}$ represents the number of IDFT samples, and i represents the imaginary number.

The time frequency synthesis unit 22 supplies the speaker drive signals d (l, $n_t$) obtained in the above manner to the respective speaker units constituting the global array 23, to cause the global array 23 to output sound.

<Description of a Sound Field Formation Process>

Figure 4:
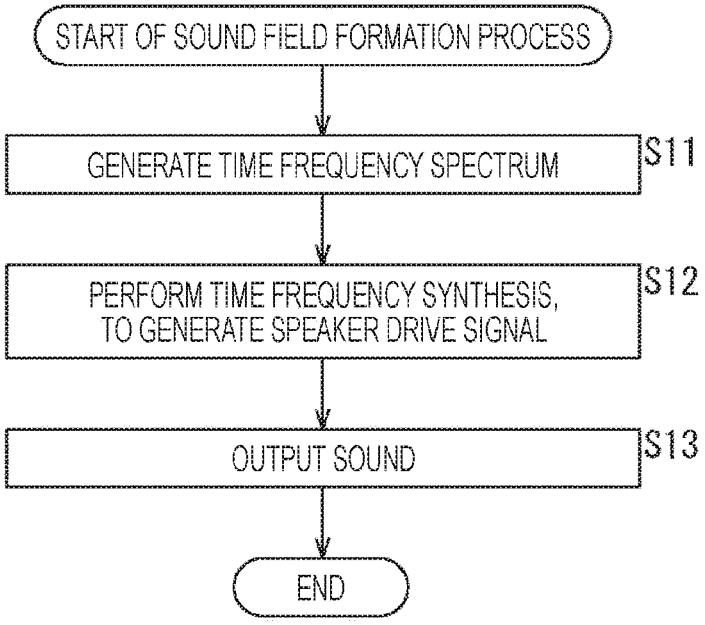
FIG. 4 is a flowchart for explaining a sound field formation process.

Next, operation of the sound field forming apparatus 11 is described. Specifically, referring now to the flowchart shown in FIG. 4, a sound field formation process to be performed by the sound field forming apparatus 11 is described below.

In step S11, on the basis of a supplied source signal, the drive signal generation unit 21 generates the time frequency spectrums of speaker drive signals for the respective speaker units constituting the global array 23, and supplies the time frequency spectrums to the time frequency synthesis unit 22.

For example, on the basis of the source signal, the drive signal generation unit 21 performs calculation according to Equation (19) using the coefficients $a^{(O)}_{nm}$ obtained by Equation (11), to generate the time frequency spectrums of the respective speaker units constituting the global array 23.

In step S12, the time frequency synthesis unit 22 performs time frequency synthesis on the time frequency spectrums of speaker drive signals supplied from the drive signal generation unit 21, to generate the speaker drive signals for the respective speaker units constituting the global array 23.

For example, the time frequency synthesis unit 22 generates the speaker drive signals for the respective speaker units by performing calculation according to Equation (22), and supplies the speaker drive signals to the global array 23.

In step S13, the global array 23 outputs a sound on the basis of the speaker drive signals supplied from the time frequency synthesis unit 22. As a result, the desired sound field, which is the desired wavefront, is formed, and the sound based on the source signal is reproduced.

After the sound field is formed in this manner, the sound field formation process comes to an end.

As described above, the sound field forming apparatus 11 generates speaker drive signals on the basis of a source signal, and reproduces the sound based on the source signal with the global array 23. Particularly, in the global array 23, general speakers 31 and higher order speakers 32 are used in combination, so that sufficiently high sound field reproducibility can be achieved even at low cost.

A method of generating speaker drive signals directly by calculation on the basis of a supplied source signal like the sound field forming apparatus 11 is particularly useful when the source signal is determined in advance, for example. In a case where a source signal is determined in advance, speaker drive signals are generated beforehand so that the sound of content or the like can be promptly reproduced when necessary.

<Second Embodiment>

<Example Configuration of a Sound Field Forming Apparatus>

Note that, in a case where speaker drive signals are generated, filter coefficients for forming a desired wavefront may be generated in advance, and the speaker drive signals may be generated by a process of convoluting the filter coefficients and a source signal.

Figure 5:
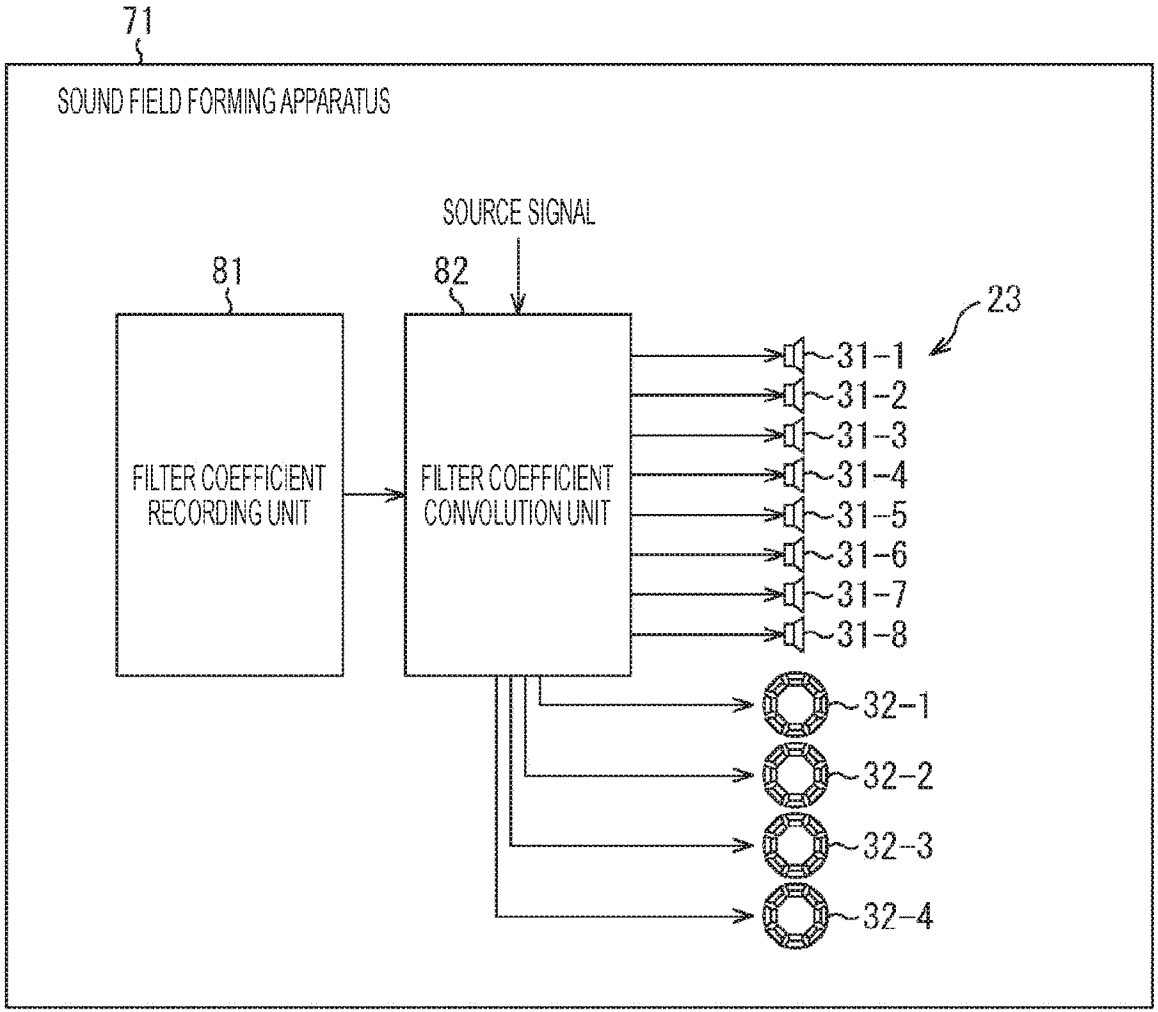
FIG. 5 is a diagram showing an example configuration of a sound field forming apparatus.

In such a case, a sound field forming apparatus is designed as shown in FIG. 5, for example. Note that, in FIG. 5, the components equivalent to those shown in FIG. 1 are denoted by the same reference numerals as those used in FIG. 1, and explanation of them will not be unnecessarily repeated.

A sound field forming apparatus 71 shown in FIG. 5 includes a filter coefficient recording unit 81, a filter coefficient convolution unit 82, and a global array 23.

The filter coefficient recording unit 81 records filter coefficients for reproducing (forming) a predetermined wavefront generated in advance, and supplies the recorded filter coefficients to the filter coefficient convolution unit 82.

The filter coefficient convolution unit 82 convolves a supplied source signal and the filter coefficients supplied from the filter coefficient recording unit 81, to generate speaker drive signals for the respective speaker units constituting the global array 23 and supply the speaker drive signals to the global array 23. In other words, the speaker drive signals for the respective speaker units are generated by a filtering process based on the filter coefficients and the source signal.

The sound field forming apparatus 71 can quickly obtain the speaker drive signals through the filtering process. Thus, the sound field forming apparatus 71 is particularly useful in a case where the source signal changes frequently.

(Filter Coefficient Recording Unit)

Here, the respective components of the sound field forming apparatus 71 are described in greater detail.

The filter coefficient recording unit 81 records filter coefficients of an audio filter for reproducing a predetermined wavefront by combining a plurality of general speakers 31 and higher order speakers 32, or, in other words, for forming a desired sound field.

For example, the filter coefficient of the time index $n_t$ for the speaker unit of a speaker index l is expressed as h (l, $n_t$). In this case, a speaker drive signal d (l, $n_t$) obtained by performing calculation according to Equation (19) and Equation (22) using the coefficient $a^{(O)}_{nm}$ shown in Equation (10) is used as a filter coefficient h (l, $n_t$).

The filter coefficient recording unit 81 records filter coefficients h (l, $n_t$) generated in advance, and supplies the filter coefficients h (l, $n_t$) to the filter coefficient convolution unit 82.

(Filter Coefficient Convolution Unit)

The filter coefficient convolution unit 82 convolves the filter coefficients h (l, $n_t$) supplied from the filter coefficient recording unit 81 and a supplied source signal, to generate speaker drive signals d (l, $n_t$) for the respective speaker units. The filter coefficient convolution unit 82 supplies the obtained speaker drive signals to the respective speaker units constituting the global array 23, and causes the global array 23 to output sound.

For example, where a source signal that is a temporal signal is represented by x ($n_t$), the filter coefficient convolution unit 82 performs calculation according to Equation (23) shown below, to convolve the filter coefficients h (l, $n_t$) and the source signal x ($n_t$) and calculate the speaker drive signals d (l, $n_t$).

[Mathematical Formula 23]

$$d(l, n_t) = \sum_{j=0}^{N} h(l, j) \times (n_t - j) \tag{23}$$

Note that, in Equation (23), N represents the filter length of the audio filter formed with the filter coefficients h (l, $n_t$).

<Description of a Sound Field Formation Process>

Figure 6:
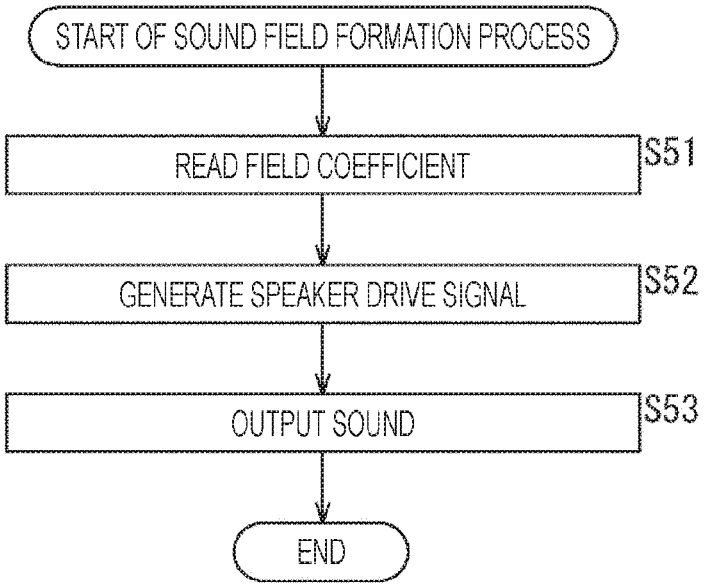
FIG. 6 is a flowchart for explaining a sound field formation process.

Next, operation of the sound field forming apparatus 71 is described. Specifically, referring now to the flowchart shown in FIG. 6, a sound field formation process to be performed by the sound field forming apparatus 71 is described below.

In step S51, the filter coefficient convolution unit 82 reads the filter coefficients h (l, $n_t$) from the filter coefficient recording unit 81.

In step S52, the filter coefficient convolution unit 82 generates the speaker drive signals d (l, $n_t$) on the basis of the filter coefficients h (l, $n_t$) read by the processing in step S51 and the supplied source signal x ($n_t$), and supplies the speaker drive signals d (l, $n_t$) to the global array 23.

For example, in step S52, calculation according to the above Equation (23) is performed, to generate the speaker drive signals d (l, $n_t$) for the respective speaker units constituting the global array 23.

In step S53, the global array 23 outputs sound on the basis of the speaker drive signals d (l, $n_t$) supplied from the filter coefficient convolution unit 82. As a result, the desired sound field, which is the desired wavefront, is formed, and the sound based on the source signal is reproduced.

After the sound field is formed in this manner, the sound field formation process comes to an end.

As described above, the sound field forming apparatus 71 generates speaker drive signals on the basis of a source signal, and reproduces the sound based on the source signal with the global array 23. In the sound field forming apparatus 71, the general speakers 31 and the higher order speakers 32 are used in combination as in the case with the sound field forming apparatus 11, so that sufficiently high sound field reproducibility can be achieved even at low cost.

<Example 1 of Application of the Present Technology>

<Uneven Density Arrangement of Speakers>

Meanwhile, in a global array to which the present technology is applied, the arrangement of general speakers and higher order speakers may be three-dimensional arrangement such as spherical arrangement, or may be two-dimensional arrangement such as annular arrangement.

Alternatively, general speakers and higher order speakers may be arranged at uniform density (equal intervals), or may be arranged at uneven density (unequal intervals).

Figure 7:
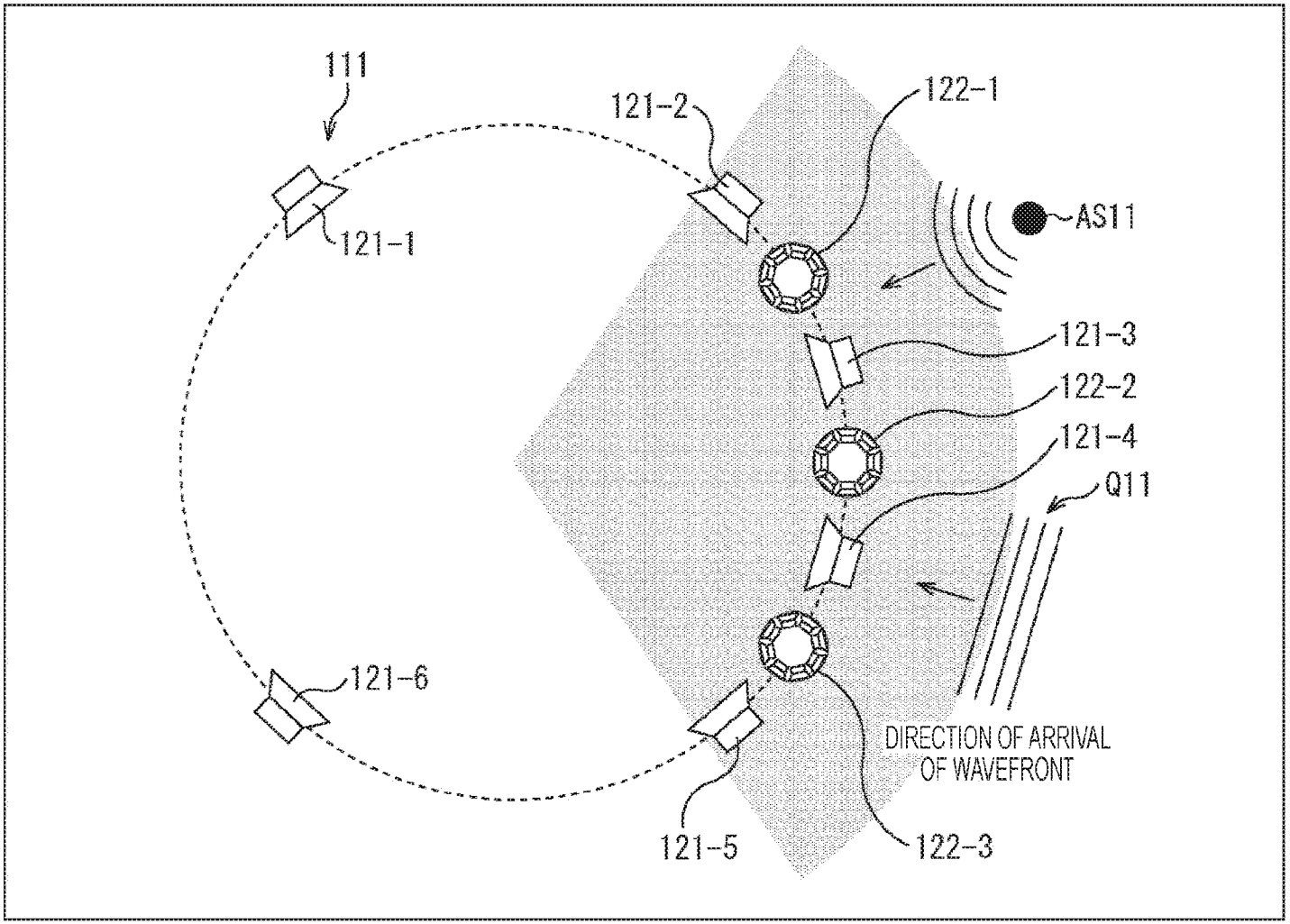
FIG. 7 is a diagram for explaining uneven density arrangement of speakers.

For example, in a case where the general speakers and the higher order speakers constituting a global array are arranged at uneven density, the arrangement shown in FIG. 7 can be adopted.

In the example illustrated in FIG. 7, a global array 111 to which the present technology is applied is formed with general speakers 121-1 through 121-6, and higher order speakers 122-1 through 122-3. This global array 111 is equivalent to the global array 23 in FIG. 2.

Note that, in the description below, the general speakers 121-1 through 121-6 will be also referred to simply as the general speakers 121 unless it is necessary to specifically distinguish the general speakers 121-1 through 121-6 from one another, and the higher order speakers 122-1 through 122-3 will be also referred to simply as the higher order speakers 122 unless it is necessary to specifically distinguish the higher order speakers 122-1 through 122-3 from one another.

Here, the six general speakers 121 and the three higher order speakers 122 are annularly arranged at uneven density, to form the global array 111.

In other words, in the portion on the right side of the global array 111 in the drawing, larger numbers of general speakers 121 and higher order speakers 122 are disposed than in the portion on the left side of the global array 111 in the drawing, and the speaker density in the right-side portion is higher. Particularly, all the higher order speakers 122 are disposed in the portion on the right side of the global array 111 in the drawing.

Here, wavefront reproducibility in the region on the inner side of the global array 111 is discussed.

When the general speakers 121 and the higher order speakers 122 are arranged at uneven density, reproducibility of a wavefront propagating toward the center position of the global array 111 from the portion with the higher speaker density is normally high. On the other hand, reproducibility of a wavefront propagating toward the center position of the global array 111 from the portion with the lower speaker density is low.

In the example illustrated in FIG. 7, the speaker density is higher on the right side of the global array 111 in the drawing.

Accordingly, a wavefront propagating from the right side to the center position of the global array 111 in the drawing can be reproduced with higher accuracy.

For example, in the example illustrated in FIG. 7, a sound source AS11 is located on the side with the larger numbers of general speakers 121 and higher order speakers 122 in the region on the outer side of the global array 111, or, in other words, is located on the upper right side of the global array 111 in the drawing. The wavefront of sound emitted from the sound source AS11 then propagates from the sound source AS11 toward the center of the global array 111.

Because of this, with the global array 111, the wavefront of sound from the sound source AS11 can be reproduced with high accuracy in the region on the inner side of the global array 111.

Likewise, with the global array 111, a wavefront propagating from the lower right side of the global array 111 toward the center position of the global array 111 in the drawing as indicated by an arrow Q11, for example, can also be reproduced with high accuracy.

In view of the above, in a case where the direction of arrival of the wavefront of sound is limited depending on the content to be reproduced, for example, the speaker arrangement in the global array 111 is only required to be determined so that the speaker density becomes higher on the side from which the wavefront is to arrive. In this manner, it is possible not only to form the wavefront of the sound of content with high reproducibility, but also to reduce the number of speakers in the global array 111.

Further, if the arrangement of the general speakers and the higher order speakers constituting a global array is determined in accordance with the shape or the like of the control region that is the region in which a sound field (wavefront) is to be reproduced with the global array, sound field formation can be efficiently performed at low cost.

Figure 8:
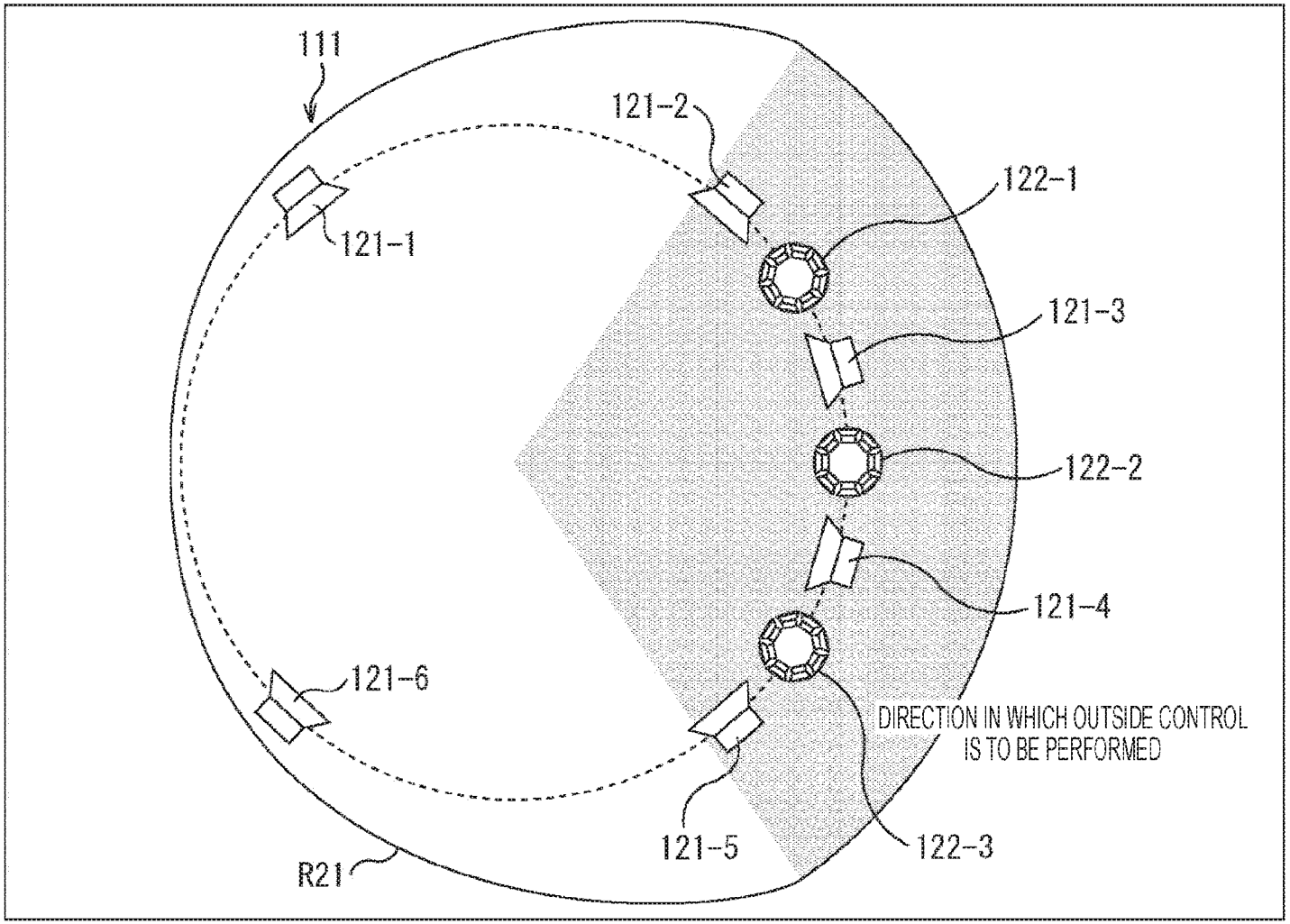
FIG. 8 is a diagram for explaining speaker arrangement depending on a control region.

In a case where the direction (region) in which a sound field is to be reproduced on the outer side of a global array is limited, the speaker arrangement shown in FIG. 8 can be adopted, for example. Note that, in FIG. 8, the components equivalent to those shown in FIG. 7 are denoted by the same reference numerals as those used in FIG. 7, and explanation of them will not be unnecessarily repeated.

In the example illustrated in FIG. 8, a region R21 including regions on the outer side and the inner side of the global array 111 is the control region (hereinafter also referred to as the control region R21) in which a sound field is to be reproduced with the global array 111.

In a case where a sound field is to be reproduced in a region on the outer side of the global array 111, the higher order speakers 122 need to be disposed in the vicinity of the region, to reproduce the sound field with sufficiently high accuracy.

Here, among the regions on the outer side of the global array 111, the region on the left side of the global array 111 in the drawing is not included in the control region R21. Accordingly, the higher order speakers 122 are not disposed on the left side of the global array 111 in the drawing, and the speaker density is low in that region.

On the other hand, among the regions on the outer side of the global array 111, the region on the right side of the global array 111 in the drawing is included in the control region R21. Accordingly, a large number of higher order speakers 122 are disposed on the right side of the global array 111 in the drawing, and the speaker density is high in that region.

As described above, in a case where the region in which a sound field is to be reproduced is limited on the outer side of the global array 111, it is sufficient that the higher order speakers 122 are arranged at high density in the vicinity of the region in which the sound field is to be reproduced, and the speaker density is made lower in the vicinities of the regions in which sound field reproduction is not necessary.

In this manner, it is possible to efficiently reproduce a sound field (wavefront) with sufficiently high accuracy, even with a small number of speakers on the inner side and the outer side of the global array 111.

Figure 9:
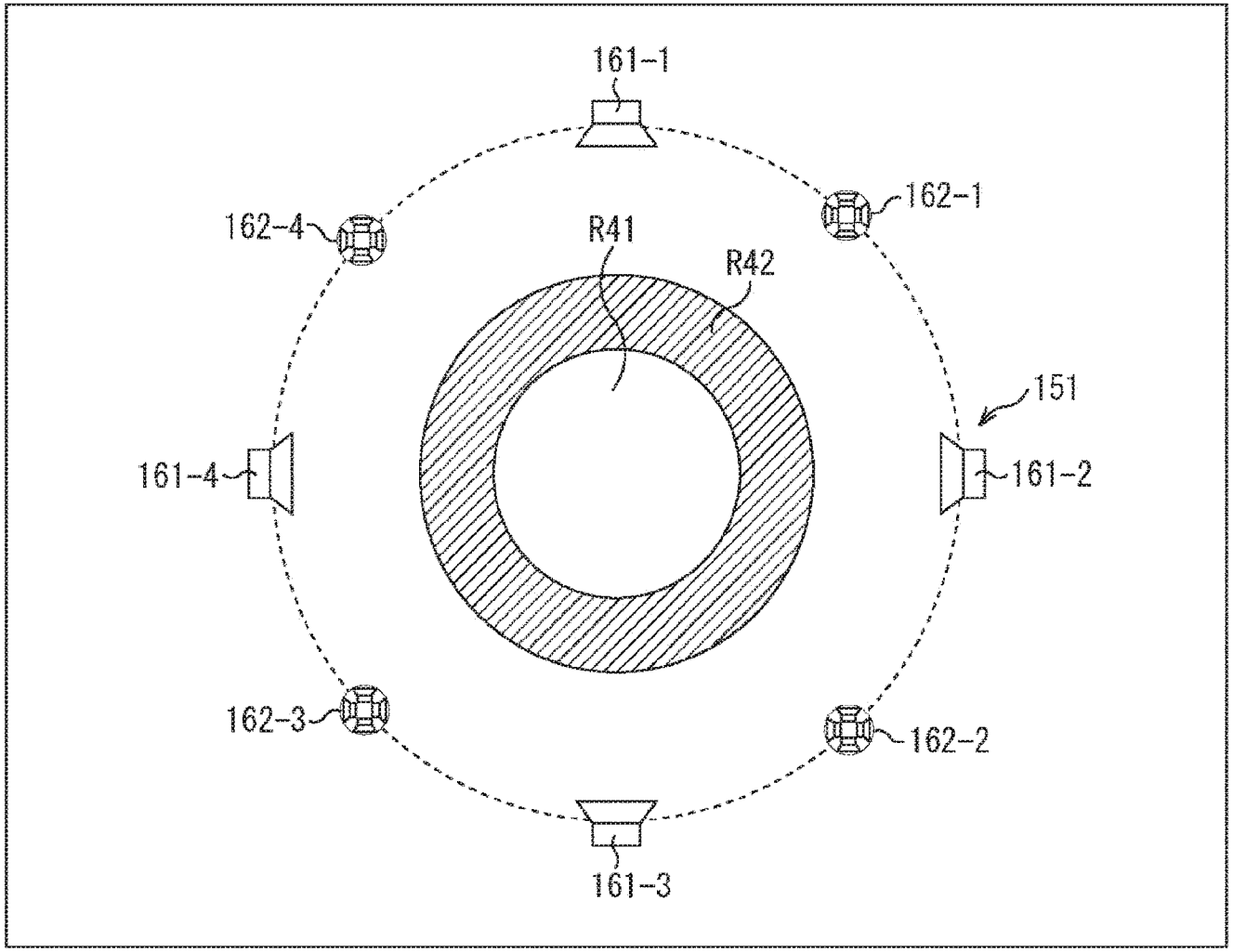
FIG. 9 is a diagram for explaining a control region.

However, in a case where there is not a large enough number of speakers to reproduce a sound field on the outer side of a global array, the control region is a region on the inner side of the global array as shown in FIG. 9, for example.

In the example illustrated in FIG. 9, a global array 151 is formed with general speakers 161-1 through 161-4, and higher order speakers 162-1 through 162-4. This global array 151 is equivalent to the global array 23 in FIG. 2.

Note that, in the description below, the general speakers 161-1 through 161-4 will be also referred to simply as the general speakers 161 unless it is necessary to specifically distinguish the general speakers 161-1 through 161-4 from one another, and the higher order speakers 162-1 through 162-4 will be also referred to simply as the higher order speakers 162 unless it is necessary to specifically distinguish the higher order speakers 162-1 through 162-4 from one another.

Here, the four general speakers 161 and the four higher order speakers 162 are annularly arranged at uniform density (equal intervals).

In this example, however, the numbers of the general speakers 161 and the higher order speakers 162 are not large enough for the radius of the global array 151. Therefore, a circular region on the inner side of the global array 151 is set as the control region. In other words, it is not possible to form a sound field (wavefront) with sufficiently high reproducibility in any region on the outer side of the global array 151.

Here, a region formed with a circular region R41 including the center position of the global array 151 and an annular (ring-like) region R42 surrounding the region R41 is set as the control region for the global array 151.

The region R41 is a zero-order control region in which a sound field is to be formed mainly with the general speakers 161, and the region R42 is a higher order control region in which a sound field is to be formed mainly with the higher order speakers 162.

<Example 2 of Application of the Present Technology>>

<Combination of Higher Order Speakers>

Further, in the examples described above, the higher order speakers constituting a global array are of the same type. However, higher order speakers of a plurality of types different from one another may be combined, to form a global array.

Here, the types of higher order speakers being different means that the numbers and the sizes of the speaker units constituting the higher order speakers are different, the speaker arrays serving as the higher order speakers have different shapes such as an annular shape and a spherical shape, the orders (order numbers), or the like of the directionalities that can be reproduced by the higher order speakers are different, for example.

Figure 10:
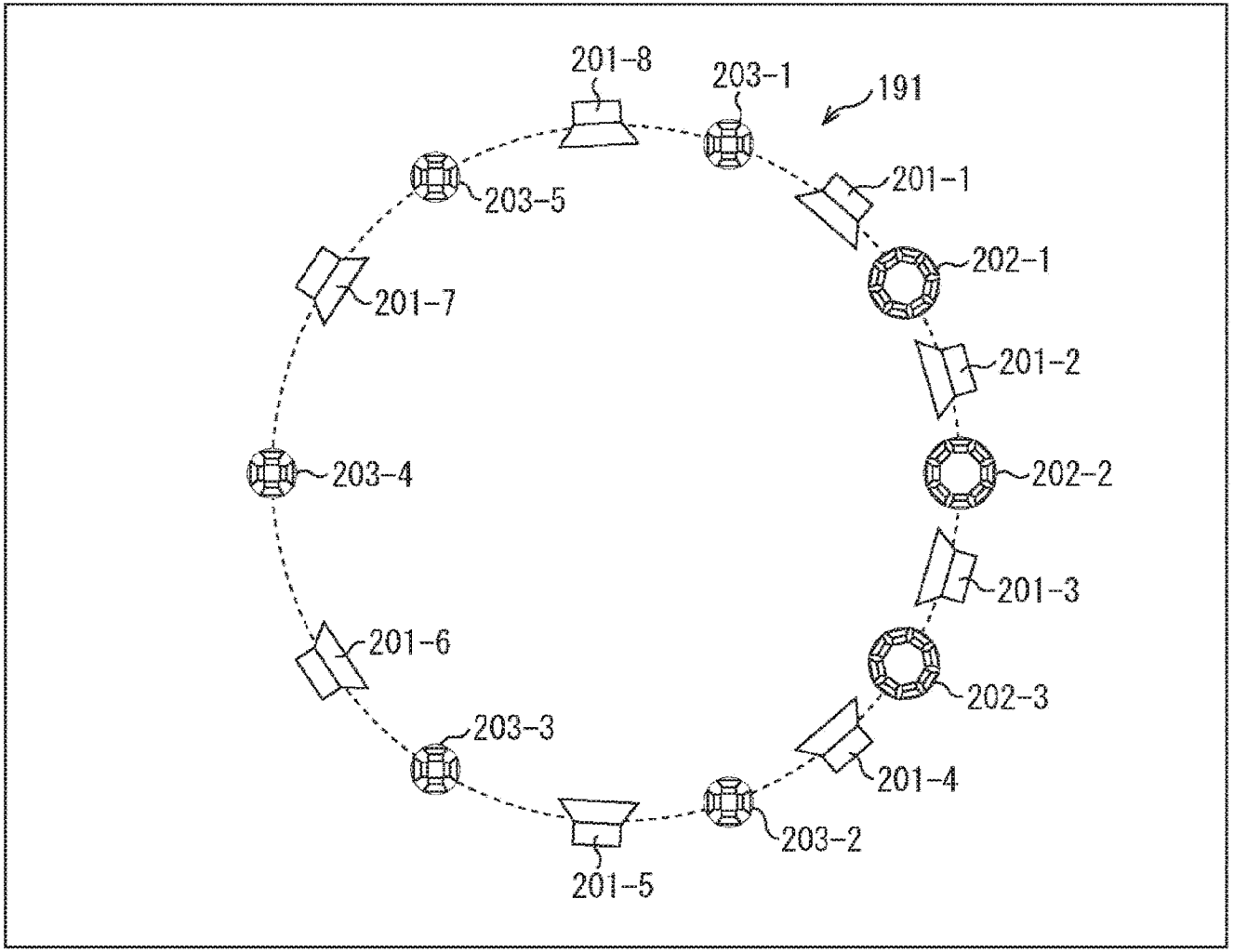
FIG. 10 is a diagram for explaining combinations of a plurality of types of higher order speakers.

In a case where higher order speakers of different types are combined to form a global array, the global array to which the present technology is applied is formed as shown in FIG. 10, for example.

A global array 191 shown in FIG. 10 is formed with general speakers 201-1 through 201-8, higher order speakers 202-1 through 202-3, and higher order speakers 203-1 through 203-5. This global array 191 is equivalent to the global array 23 in FIG. 2.

Note that, in the description below, the general speakers 201-1 through 201-8 will be also referred to simply as the general speakers 201 unless it is necessary to specifically distinguish the general speakers 201-1 through 201-8 from one another, and the higher order speakers 202-1 through 202-3 will be also referred to simply as the higher order speakers 202 unless it is necessary to specifically distinguish the higher order speakers 202-1 through 202-3 from one another. Likewise, in the description below, the higher order speakers 203-1 through 203-5 will be also referred to simply as the higher order speakers 203 unless it is necessary to specifically distinguish the higher order speakers 203-1 through 203-5 from one another.

Here, the eight general speakers 201, the three higher order speakers 202, and the five higher order speakers 203 are annularly arranged at uneven density (equal intervals).

Further, the higher order speakers 202 and the higher order speakers 203 are of different types from each other. Specifically, the higher order speakers 202 are higher order speakers that are formed with a larger number of speaker units than those of the higher order speakers 203, and are capable of reproducing directionality of a higher order than the higher order speakers 203, for example.

The installation positions of the general speakers 201, the higher order speakers 202, and the higher order speakers 203, the number of speakers, the types of the higher order speakers, and the like are appropriately determined in accordance with the control region of the global array 191, so that a sound field can be efficiently formed with sufficiently high reproducibility at low cost.

Particularly, the installation positions and the numbers of the general speakers 201, the higher order speakers 202, and the higher order speakers 203, and the like are determined in accordance with the sound field (wavefront) reproducibility required in the zero-order control region that can be controlled by the general speakers 201 in the control region. In this manner, a sound field can be efficiently formed with sufficiently high reproducibility in the zero-order control region.

Likewise, the installation positions, the numbers, the types, and the like of the higher order speakers 202 and the higher order speakers 203 are determined in accordance with the sound field (wavefront) reproducibility required in the higher order control region in the control region, so that a sound field can be efficiently formed with sufficiently high reproducibility in the higher order control region.

<Example Configuration of a Computer>

Meanwhile, the above described series of processes may be performed by hardware or may be performed by software. In a case where the series of processes are to be performed by software, the program that forms the software is installed into a computer. Here, the computer may be a computer incorporated into special-purpose hardware, or may be, for example, a general-purpose computer or the like that can execute various kinds of functions if various kinds of programs are installed thereinto.

Figure 11:
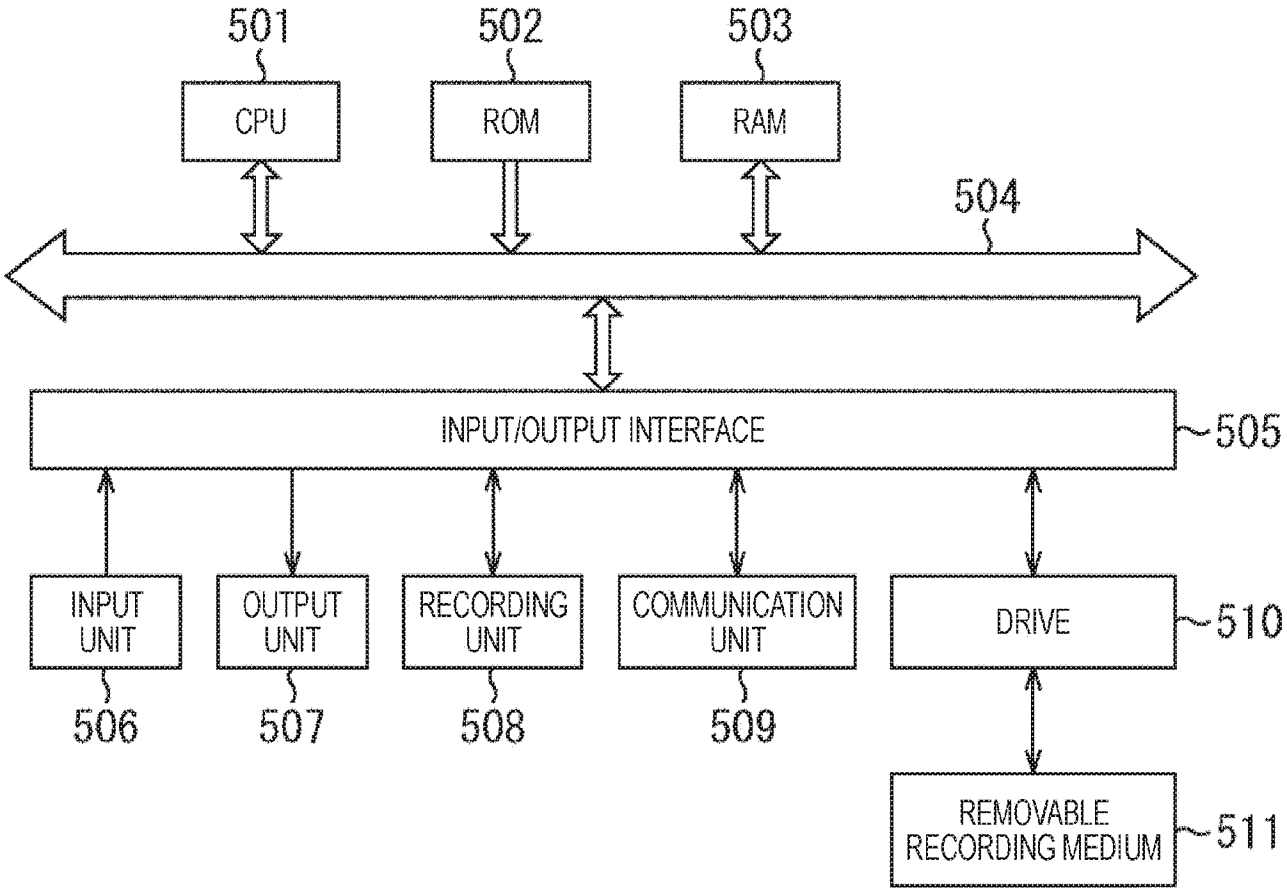
FIG. 11 is a diagram showing an example configuration of a computer.

FIG. 11 is a block diagram showing an example configuration of the hardware of a computer that performs the above described series of processes in accordance with a program.

In the computer, a central processing unit (CPU) 501, a read only memory (ROM) 502, and a random access memory (RAM) 503 are connected to one another by a bus 504.

An input/output interface 505 is further connected to the bus 504. An input unit 506, an output unit 507, a recording unit 508, a communication unit 509, and a drive 510 are connected to the input/output interface 505.

The input unit 506 is formed with a keyboard, a mouse, a microphone array, an imaging device, and the like. The output unit 507 is formed with a display, a speaker array, and the like. The recording unit 508 is formed with a hard disk, a nonvolatile memory, or the like. The communication unit 509 is formed with a network interface or the like. The drive 510 drives a removable recording medium 511 such as a magnetic disc, an optical disc, a magnetooptical disc, or a semiconductor memory.

In the computer having the above configuration, the CPU 501 loads a program recorded in the recording unit 508 into the RAM 503 via the input/output interface 505 and the bus 504, for example, and executes the program, so that the above described series of processes are performed.

The program to be executed by the computer (the CPU 501) may be recorded on the removable recording medium 511 as a packaged medium or the like, and be then provided, for example. Alternatively, the program can be provided via a wired or wireless transmission medium, such as a local area network, the Internet, or digital satellite broadcasting.

In the computer, the program can be installed into the recording unit 508 via the input/output interface 505 when the removable recording medium 511 is mounted on the drive 510. The program can also be received by the communication unit 509 via a wired or wireless transmission medium, and be installed into the recording unit 508. Alternatively, the program may be installed beforehand into the ROM 502 or the recording unit 508.

It should be noted that the program to be executed by the computer may be a program for performing processes in chronological order in accordance with the sequence described in this specification, or may be a program for performing processes in parallel or performing a process when necessary, such as when there is a call.

Further, embodiments of the present technology are not limited to the above described embodiments, and various modifications may be made to them without departing from the scope of the present technology.

For example, the present technology can be embodied in a cloud computing configuration in which one function is shared among a plurality of devices via a network, and processing is performed by the devices cooperating with one another.

Further, the respective steps described with reference to the above described flowcharts can be carried out by one device or can be shared among a plurality of devices.

Furthermore, in a case where a plurality of processes is included in one step, the plurality of processes included in the step can be performed by one device or can be shared among a plurality of devices.

Further, the advantageous effects described in this specification are merely examples, and the advantageous effects of the present technology are not limited to them and may include other effects.

Furthermore, the present technology may also be embodied in the configurations described below.

(1)

A speaker array including a plurality of higher order speakers, and a plurality of general speakers, in which a type, a number, or installation positions of the higher order speakers are determined in accordance with wavefront reproducibility in a second region located on an outer side of a first region controlled by the general speakers.

(2)

The speaker array according to (1), in which numbers or installation positions of the higher order speakers and the general speakers are determined in accordance with wavefront reproducibility in the first region.

(3)

The speaker array according to (1) or (2), in which the plurality of higher order speakers and the plurality of general speakers are arranged at uneven density.

(4)

The speaker array according to any one of (1) to (3), in which the plurality of higher order speakers includes higher order speakers of different types from one another.

(5)

The speaker array according to (4), in which the higher order speakers of different types from one another are higher order speakers capable of reproducing different directionalities.

(6)

The speaker array according to any one of (1) to (5), in which the higher order speakers are speakers capable of reproducing a plurality of directionalities.

(7)

The speaker array according to any one of (1) to (6), in which the general speakers are speakers capable of reproducing only one directionality.

(8)

A signal processing apparatus including:

a speaker array including a plurality of higher order speakers, and a plurality of general speakers, a type, a number, or installation positions of the higher order speakers being determined in accordance with wavefront reproducibility in a second region located on an outer side of a first region controlled by the general speakers; and a drive signal generation unit configured to generate a drive signal for the speaker array on the basis of a source signal.

(9)

The signal processing apparatus according to (8), in which numbers or installation positions of the higher order speakers and the general speakers are determined in accordance with wavefront reproducibility in the first region.

(10)

The signal processing apparatus according to (8) or (9), in which the plurality of higher order speakers and the plurality of general speakers are arranged at uneven density.

(11)

The signal processing apparatus according to any one of (8) to (10), in which the plurality of higher order speakers includes higher order speakers of different types from one another.

(12)

The signal processing apparatus according to (11), in which the higher order speakers of different types from one another are higher order speakers capable of reproducing different directionalities.

(13)

The signal processing apparatus according to any one of (8) to (12), in which the higher order speakers are speakers capable of reproducing a plurality of directionalities.

(14)

The signal processing apparatus according to any one of (8) to (13), in which the general speakers are speakers capable of reproducing only one directionality.

REFERENCE SIGNS LIST

11 Sound field forming apparatus
21 Drive signal generation unit
22 Time frequency synthesis unit
23 Global array
31-1 to 31-8, 31 General speaker
32-1 to 32-4, 32 Higher order speaker
81 Filter coefficient recording unit
82 Filter coefficient convolution unit

The invention claimed is:

1. A speaker array comprising a plurality of higher order speakers, and a plurality of general speakers, wherein a type, a number, or installation positions of the higher order speakers are determined in accordance with wavefront reproducibility in a second region located on an outer side of a first region controlled by the general speakers.

2. The speaker array according to claim 1, wherein numbers or installation positions of the higher order speakers and the general speakers are determined in accordance with wavefront reproducibility in the first region.

3. The speaker array according to claim 1, wherein the plurality of higher order speakers and the plurality of general speakers are arranged at uneven density.

4. The speaker array according to claim 1, wherein the plurality of higher order speakers includes higher order speakers of different types from one another.

5. The speaker array according to claim 4, wherein the higher order speakers of different types from one another are higher order speakers capable of reproducing different directionalities.

6. The speaker array according to claim 1, wherein the higher order speakers are speakers capable of reproducing a plurality of directionalities.

7. The speaker array according to claim 1, wherein the general speakers are speakers capable of reproducing only one directionality.

8. A signal processing apparatus comprising:

a speaker array including a plurality of higher order speakers, and a plurality of general speakers, a type, a number, or installation positions of the higher order speakers being determined in accordance with wavefront reproducibility in a second region located on an outer side of a first region controlled by the general speakers; and a drive signal generation unit configured to generate a drive signal for the speaker array on a basis of a source signal.

9. The signal processing apparatus according to claim 8, wherein numbers or installation positions of the higher order speakers and the general speakers are determined in accordance with wavefront reproducibility in the first region.

10. The signal processing apparatus according to claim 8, wherein the plurality of higher order speakers and the plurality of general speakers are arranged at uneven density.

11. The signal processing apparatus according to claim 8, wherein the plurality of higher order speakers includes higher order speakers of different types from one another.

12. The signal processing apparatus according to claim 11, wherein the higher order speakers of different types from one another are higher order speakers capable of reproducing different directionalities.

13. The signal processing apparatus according to claim 8, wherein the higher order speakers are speakers capable of reproducing a plurality of directionalities.

14. The signal processing apparatus according to claim 8, wherein the general speakers are speakers capable of reproducing only one directionality.

* * * * *